United States Patent [19]

Wolfe et al.

[11] 4,045,155

[45] Aug. 30, 1977

[54] BURNER SYSTEM WITH ABSORBENT CARBON FLAME RESPONSIVE SWITCH

[75] Inventors: Denis G. Wolfe, Santa Ana; Joseph S. Danon, El Toro, both of Calif.

[73] Assignee: Robertshaw Controls Company, Richmond, Va.

[21] Appl. No.: 572,801

[22] Filed: Apr. 29, 1975

Related U.S. Application Data

[62] Division of Ser. No. 412,844, Nov. 5, 1973, Pat. No. 3,883,837.

[51] Int. Cl.[2] ..... F23N 5/02

[52] U.S. Cl. ..... 431/42; 431/51; 200/81.8

[58] Field of Search ..... 431/42–58; 73/368.2; 200/81.8

[56] References Cited

U.S. PATENT DOCUMENTS

| | | | |
|---|---|---|---|
| 2,426,663 | 9/1947 | Bevins | 73/368.2 |
| 2,626,183 | 1/1953 | Jacobs | 73/368.2 |
| 2,640,313 | 6/1953 | Cobb | 431/42 |
| 3,132,518 | 5/1964 | Salmon | 73/368.2 |
| 3,221,319 | 11/1965 | Lindberg | 337/326 |
| 3,766,783 | 10/1973 | Tortoso | 73/368.2 |
| 3,843,308 | 10/1974 | Graham et al. | 431/78 |
| 3,934,417 | 1/1976 | Wolfe et al. | 73/368.2 |
| 3,992,944 | 11/1976 | Woodle | 73/368.2 |

*Primary Examiner*—Carroll B. Dority, Jr.
*Attorney, Agent, or Firm*—Anthony A. O'Brien

[57] ABSTRACT

A thermal responsive switch employs a gas expansion operating member movable by changes in pressure of a gas charge in a chamber containing a carbonaceous adsorbent material formed from a compound of carbon and non-carbon component by removing the non-carbon component.

4 Claims, 5 Drawing Figures

BURNER SYSTEM WITH ABSORBENT CARBON FLAME RESPONSIVE SWITCH

CROSS REFERENCE TO RELATED APPLICATION

This application is a Divisional Application of pending application Ser. No. 412,844 filed Nov. 5, 1973 and now U.S. Pat. No. 3,883,837.

BACKGROUND OF THE INVENTION

1. Field of the Invention

The invention relates to thermal responsive switches and, in particular, to a switch utilizing the thermal expansion and contraction of a gas for operating a pair of contacts.

2. Description of the Prior Art

The prior art, as exemplified in U.S. Pat. Nos. 2,221,633, 2,627,911, 3,282,325, 3,521,814, and 3,568,123, contains many devices and switches which are thermally operated. Some of the thermal responsive devices have enclosed chambers containing an activated material, such as activated charcoal, with a thermally expandable and contractable gas, such as difluorodichloromethane, dimethylether, carbon dioxide, argon or nitrogen. Activated charcoal is made by eroding funnel-like pores or cavities in carbonized organic materials, such as wood, coal, coconut husks, bones, etc. by a reactive material, such as steam, carbon dioxide or the like. While gas expansion thermally operated switches containing an activated charcoal exhibit improved operation due to a larger volume or pressure change per degree of temperature change over switches containing only gas, attempts to manufacture such activated charcoal containing switches in quantities have generally met with failure; it has been impossible to predict or avoid large variations in volume or pressure change per degree of temperature change in different batches of activated charcoal thus producing switches which are actuated at different temperature; the increase in volume or pressure change per degree of temperature change was not sufficiently large to warrant the added manufacturing cost; and the activated charcoal containing switches were substantially deficient in volume or temperature change per degree of temperature change compared to alternate switches using vapor expansion from a liquid, such as mercury, to produce a substantial movement of the contacts making rapid positive opening and closing of the contacts possible.

Also, the prior art, as exemplified in U.S. Pat. Nos. 1,744,735, 3,258,363, 3,442,819, 3,516,791, and the publication (USSR Academy of Sciences, M. M. Dubinin, "Thermal Treatment and Microporous Structure of Carbonaceous Adsorbents", *Proceedings of the Fifth Conference on Carbon,* Vol, 1, 1962, pages 81–87) contains many adsorbent carbon materials including decomposed polyvinylidene chloride and polyvinylidene fluoride. Adsorbent carbon materials are widely used in removing contaminants or the like from gases or liquids. Polyvinylidene chloride and polyvinylidene fluoride, in particular, have been recognized for their "molecular sieve" properties; that is, their ability to adsorb certain gaseous materials which have small molecular size while being incapable of adsorbing other gaseous materials which have larger molecular sizes.

Many prior art flame switches employ mercury actuators with a mercury containing bulb for sensing a flame. Due to the corrosive properties of mercury, particularly at temperatures associated with flame sensing, such mercury actuators are subject to deterioration and failure. The prior art has failed to produce suitable flame sensing switches which are practical and acceptable replacements for switches employing mercury actuators.

SUMMARY OF THE INVENTION

The invention is summarized in that a thermal responsive switch includes a pair of contacts, means forming a chamber, a charge of gas in the chamber, a carbonaceous adsorbent material in the chamber capable of absorbing a quantity of the gas, and a member movable in response to a change in gas pressure in the chamber for moving one of the pair of contacts relative to the other contact, said carbonaceous adsorbent material being formed from a compound of carbon and a non-carbon component by removing the non-carbon component to produce cavities of sufficient size to absorb the gas.

An object of the invention is to construct a thermal responsive switch having contacts which are opened and closed by the thermal expansion and contraction of a gas with substantially faster and greater contact movement then prior art thermal switches employing gas expansion and contraction.

Another object of the invention is to provide a switch which is operated by the adsorpotion and desorption of a gas from a carbon adsorption material which can be reliably and dependably manufactured in large quantities.

A further object of the invention is to construct a thermal responsive switch which can be used as a substitute for present switches utilizing the vapor expansion of liquid mercury.

It is also an object of the invention to construct a switch which is rapidly closed or opened when a limit or preselected temperature or narrow range of temperatures is reached.

An additional feature of the invention is the provision of a movable switch operator biased by a spring against the pressure within a thermal gas expansion chamber wherein the spring has a force differential coefficient which is substantially less than that of a linear spring throughout the movement of the switch operator.

Other objects, features and advantages of the invention are apparent from the description and accompanying drawings.

DESCRIPTION OF THE PREFERRED EMBODIMENTS

Figure 1:
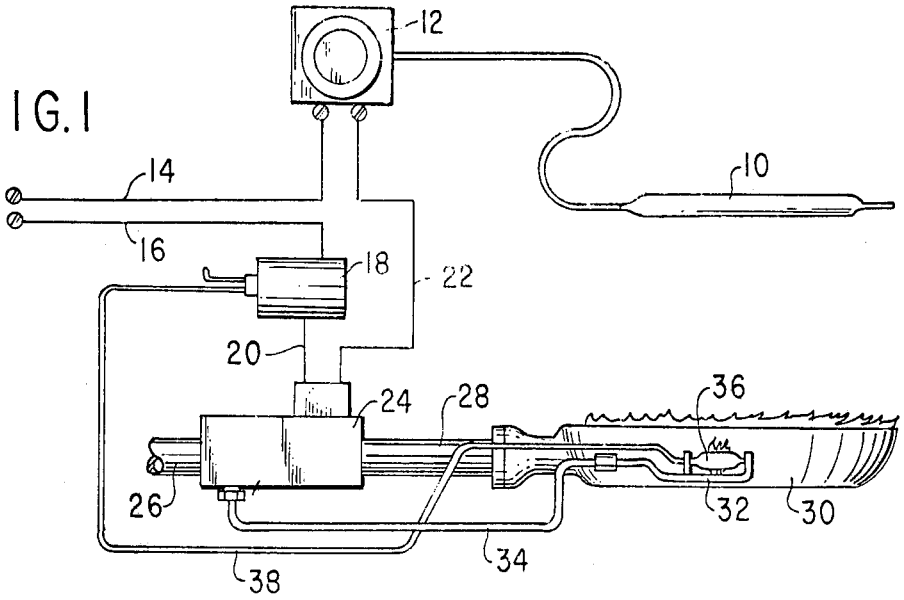
FIG. 1 is a diagram of a burner system employing a flame switch in accordance with the invention.

As illustrated in FIG. 1, the invention is embodied in an oven burner system containing an oven temperature sensor 10 controlling a thermostat switch 12 in series with an electrical line 14 connected to one terminal of an electrical energy source. The other terminal of the source is connected by a lead 16 to one side of a flame switch 18. The other side of the flame switch 18 and the thermostat switch 12 are connected by respective electrical leads 20 and 22 to an electrically operated valve 24 which is open when energized. The inlet of the valve 24 is connected by a conduit 26 to a gaseous fuel source, such as a natural gas supply, and the outlet of the valve 24 is connected by a conduit 28 to a main burner 30. Thermal ignition means, such as a constant burning pilot burner 32 in igniting proximity to the main burner 30, is connected by conduit 34 to the inlet side of the valve 24. A flame sensing bulb 36 positioned in the path of at least a portion of the flame from the pilot burner 32 is connected by a capillary tube 38 to the flame switch 18 for opening and closing the flame switch 18.

Figure 2:
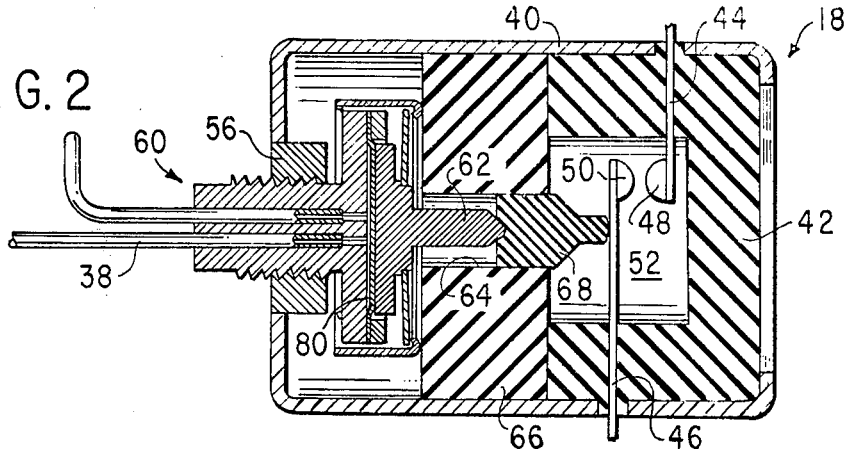
FIG. 2 is a detailed cross section view of a switch device in the burner system of FIG. 1.
Figure 3:
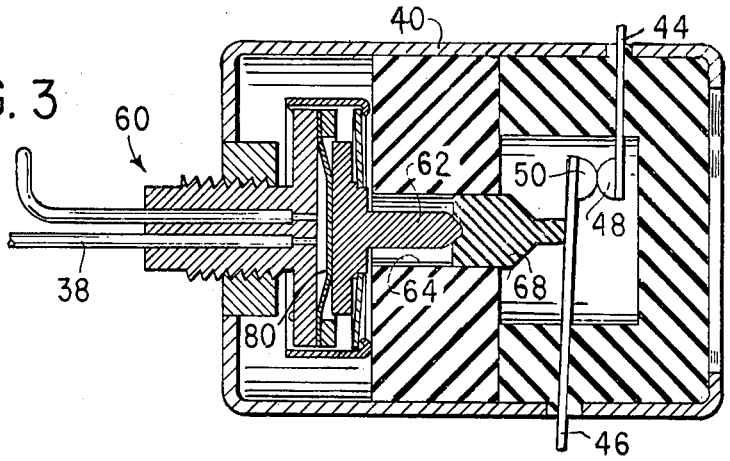
FIG. 3 is a view similar to FIG. 2 but illustrating switch contacts in a different position.

As illustrated in FIGS. 2 and 3, the flame switch 18 has a housing 40 with acup-shaped insulator 42 supporting a pair of resilient contact arms 44 and 46 connected to the respective electrical leads 16 and 20 (FIG. 1). Aligned contacts 48 and 50 are mounted on ends of the respective arms 44 and 46 within a central cavity 52 of the insulator 42. The resilient arm 46 is mounted in a position within the insulator 42 to normally hold the contact 50 spaced from the contact 48.

The housing 40 has a nut portion 56 adjustably supporting a switch actuator indicated generally at 60. The switch actuator 60 has a plunger 62 extending into a bore 64 within an insulative block 66 in the housing 40 to engage an insulative operator 68 which engages the contact arm 46 and is slidably supported within the bore 64.

Figure 4:
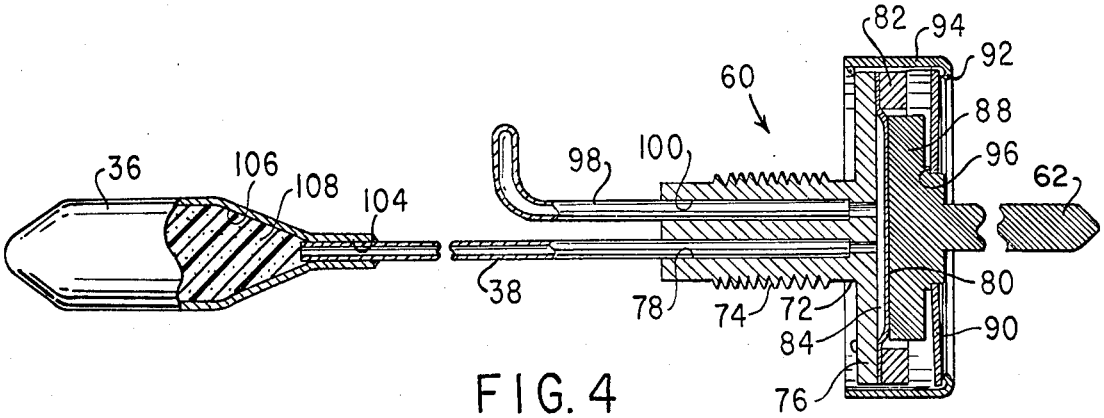
FIG. 4 is a cross section view of the switch actuator for the switch of FIG. 1.

The switch actuator 60, as shown in FIG. 4, has a support member 72 with a threaded portion 74 and a flange portion 76 through which a bore 78 extends. One end of the tube 38 is suitably secured and sealed in the bore 78. A flexible diaphragm 80 is secured to the periphery of the face of the flange portion 76 by suitable means such as an annular spacer 82 and a seam weld to form a chamber 84 which communicates with the tube 38. The flexible diaphragm 80 is made from a suitable flexible material such as a 0.127 millimeter (0.005 inch) thick sheet of 301 Stainless Steel. The plunger 62 has a head portion 88 which is biased against the diaphragm 80 by non-linear spring means, such as a washer-like, nearly-flat frusto-conical spring 90, known as a Belleville spring. The outer periphery of the spring 90 is held by an inward extending lip 92 of an annular retainer 94 suitable secured to the flange portion 76 of the support member 72 such as by welding. The inner periphery of the spring 90 surrounding an opening through which the plunger 62 extends engages a shoulder 96 formed on the plunger 62. The spring 90 is formed from a suitable metal having an elastic spring property within the range of operation.

As used herein, the term "spring rate" or "force differential coefficient" refers to the incremental amount of additional force required to produce an additional incremental deflection per such incremental deflection of spring. For a linear spring where the deflection is equal to the applied force times a constant, the force differential coefficient is equal to the constant throughout the range of operation of the spring.

The spring 90 has a force per deflection which is non-linear such that a portion of its range of deflection has a force differential coefficient which is substantially less than that of a linear spring. The retainer 94 is positioned on the support member 72 such as to set the operational range of the spring 90 into the portion of its range of deflection where the spring 90 has the low spring rate or force differential coefficient which is substantially less than that of a linear spring throughout the range of movement of the plunger 62. The spring 90 is designed to bias the head portion 88 against the diaphragm 80 throughout the range of movement of the plunger 62; the spring 90 having a force differential coefficient which is greater than that of springs which reverse and require a force opposite to the force of gas pressure in the chamber 84 to return to the initial position.

A charging tube 98 is secured within a bore 100 extending through the support member 72 in communication with the chamber 84.

The other end of the tube 38 is suitable secured in an opening 104 of the bulb 36 which forms a chamber 106 containing a porous carbonaceous material which has gas adsorbent properties. The bulb 36 and tube 38 are made of suitable high temperature materials, such as Incoloy 800 or stainless steel 304, which can withstand the high temperatures associated with the flame without any substantial build-up of carbonaceous biproducts from the flame. The chambers 106 and 84 and the tubes 38 and 98 contain a charge or quantity of gas, such as a noble gas selected from helium, neon, argon, krypton or xenon. Other gases which are non-reactive at the temperature of use can be employed as long as the gases have a molecular size which is readily absorbed by the carbonaceous material 108. The particular gas used is selected by considering the cost and desired pressure or volume change per degree temperature change, which pressure or volume change increases directly with the molecular weight of the gas; for example, xenon produces a greater pressure or volume change per degree temperature change than krypton.

The adsorbent carbon material 108 is made from granules of a compound containing carbon and a non-carbon component by removing the non-carbon component to leave a carbonaceous skeletal structural having cavities of sufficient size to receive and adsorb substantial quantities of the gas. Preferably, the compound is a synthetic polymer having volatile components, such as hydrogen and halogen, which can be driven off by heat leaving a carbonaceous skeletal structural which is porous. Suitable synthetic polymers are polyvinylidene chloride and polyvinylidene fluoride, the former being available in copolymer form, SARAN 113 from DOW Chemical Company. Polyvinylidene fluoride and polyvinylidene chloride are formed into adsorbent carbons by carbonizing or pyrolytic decomposition in a purifying atmosphere, such as a vacuum or a purging flow of inert gas. Carbonizing is performed by heating to a temperature less than the melting point but greater than the temperature at which decomposition can be initially observed. For polyvinylidene chloride, carbonizing is performed at a temperature in the range from 138° C (280° F) to 177° C (350° F). The duration of heating required for complete carbonization of the synthetic polymer is dependent on the size of the granules of the synthetic polymer and the temperature employed. Along the utilizing a predetermined temperature and duration for a certain size of granular synthetic polymer, observation of a reduction is gas being removed by a vacuum system or the gas being evolved from the granular material are methods of determining complete carbonization. During carbonization, the non-carbon components, hydrogen and halogen, are volatilized and removed from the synthetic polymer structure leaving a carbon skeletal structure which is highly porous. After the synthetic polymer is carbonized, the carbonized polymer can be subjected to a higher temperature up to about 1510° C. (2,750° F.) to outgas hydrogen and halogen gases which have been adsorbed. Outgassing can be completed in a short duration for example 15 minutes.

In the manufacture of the thermal responsive switch a measured quantity of granular adsorbent carbon material 108 is placed within the bulb 36, and the bulb 36 and the tube 38 are assembled with the remaining parts of the switch actuator 60. The switch actuator 60 is assembled in the housing 40 with the other switch elements. The unsecured end of the tube 98 is open and connected to a suitable evacuating and charging apparatus by which a vacuum is drawn in the tube 98 which the bulb 36 is heated to outgas air which is adsorbed by the carbon material 108. The temperature of the bulb 36 is then adjusted to a preselected operating temperature, or limit temperature, while a charge of gas is supplied through the tube 98 to the chambers 84 and 106 and the tube 38 until the switch contacts 50 and 48 are closed by movement of the plunger 62. At this point, the open end of the tube 98 is sealed completing the manufacture of the thermal responsive switch.

In operation of the oven burner system shown in FIG. 1, a pilot flame from the pilot burner 32 impinging upon the bulb 36 operates the flame switch 18 closing a circuit between the lines 16 and 20. The thermostat 12 in response to a temperature sensed by the sensor 10 below a selected oven temperature completes a circuit through lines 14 and 22 to the electrically operated valve 24 which opens allowing gaseous fuel from conduit 26 to pass through conduit 28 to the burner 30 where it is ignited by the pilot flame from the pilot burner 32. When the temperature of the oven rises sufficiently, the sensor 10 operates the thermostat 12 to open the circuit between lines 14 and 22 thus allowing the valve 24 to close the terminate the flow of gas from conduit 26 to conduit 28 and the burner 30. In the event that the pilot burner 32 should be extinguished, the flame switch 18 opens the circuit between lines 16 and 20 thus preventing the energization of the valve 24 and flow of gas from conduit 26 to conduit 28.

Referring to FIG. 4, the heating of the bulb 36 by the flame increases the gas pressure within the bulb 36 due to the desorption of the gas from the carbon material 108 and the increase in the kinetic energy of non-adsorbed gas within the bulb 36. The increase in pressure in the bulb 36 is applied through tube 38 to chamber 84 extending a force through diaphragm 80 on the head 88 of plunger 62. When the force of the gas pressure exceeds the set bias force of the spring 90, the plunger is moved to its advanced position as illustrated in FIG. 3 depressing the insulative switch operator 68 and the switch arm 46 to engage the contact 50 with the contact 48 thus completing a circuit between the contact arms 46 and 44. In the even of extinguishment of the flame impinging upon the bulb 36, the carbon material 108 is allowed to cool which readily adsorbs a quantity of the gas within the chamber 106 reducing the pressure within the chamber 106, tube 38 and chamber 84. When the pressure is reduced within the chamber 84 sufficiently to reduce the force from pressure by the diaphragm 80 on the plunger 62 below the force of the spring 90, the plunger 62 retracts allowing the spring force of the contact arm 46 to move the contact 50 from engagement with the contact 48 and to move the switch operator 68 into the bore 64 thus opening the circuit between the switch arms 44 and 46.

It is particularly advantageous that the spring 90 is set within an operational range where it has a low spring rate or a force differential coefficient which is less than that of the linear spring. Thus, when the pressure in the chamber 84 produces a force on the plunger 62 within the operational range of the thermal responsive switch, a slight change of pressure within the chamber 84 produces a significant change in the position of the plunger 62 resulting in rapid opening and closing of the switch contacts 50 and 48. The rapid opening and closing of the contacts 48 and 50 helps minimize arcing and contact chatter which can result in switch failures. Additionally, the setting of the spring 90 in the low spring rate range of operation causes the operational movement of the plunger 62 to occur within a narrow preselected operational range of temperatures or at a preselected operating temperature determined by the characteristics of the spring 90; thus, insuring that the thermal expansion and contraction of the gas within the chamber 106 will repeatedly and reliably operate the switch contacts 48 and 50 at or substantially near the preselected operating temperature.

One important factor to the improved thermal responsive switch is the utilization of an unactivated carbonized compound, and, in particular, to the utilization of a carbonized synthetic polymer, such as carbonized polyvinylidene chloride or polyvinylidene fluoride. The volume or pressure change per degree of temperature change for the carbonized synthetic polymer is substantially greater at elevated temperatures, such as are found in flame sensors, than for gas operated thermal responsive devices containing activated materials, such as activated charcoal. Also, the employment of adsorbent carbonized synthetic polymer achieves a uniformity in manufacturing thermal responsive switches which cannot be achieved with the employment of activated materials. Different batches of carbonized polyvinylidene chloride produced in different process runs have substantially identical adsorption properties, whereas different batches of activated material vary widely in adsorption properties. Thus, the thermal responsive device employing an unactivated carbonized compound makes possible the practical manufacture of large quantities of dependable thermal responsive switches which utilize adsorbent carbon and gas.

The thermal responsive switch employing the carbonaceous decomposed compound or carbonized synthetic polymer is particularly suited for flame sensing. The combination of the carbonaceous decomposed compound with aa noble gas, and particularly, one of the heavier noble gases, argon, krypton and xenon, produces a switch actuator which can withstand temperatures significantly higher than many mercury containing actuators. Thus, the present thermal responsive switch produces an acceptable, practical, and longer lasting substitute the present mercury-containing switches which are subject to mercury corrosion.

Another advantage of employing the unactivated carbonized compound or polymer as opposed to employing activated materials is that the unactivated carbonized compound produces substantially more volume or pressure changes per degree temperature change than the activated materials. The increased volume or pressure change per degeee temperature change produces more rapid and positive movement of the contact 50 than is possible with similar switches employing only a gas charge or an activated material with a gas charge. The more rapid and positive opening and closing of the contacts reduces problems and failures for arcing, contact bounce and chatter; thus, the employment of the unactivated carbonized compound makes possible an improved thermal switch which is substantially superior to switches employing only a gas charge or a gas charge with activated materials.

While the structural distinctions or properties of the carbonized synthetic polymer that cause its improved pressure or volume change per degree temperature change cannot be visually observed, various theories of the structural properties have been formulated by observation of other properties of the carbonized polymer. Activated carbons, such as activated charcoal, have pores or cavities which are funnel-shaped or cone-shaped; whereas, the carbonized synthetic polymer has cavities which are slit-like or have substantial portions with relatively uniform width throughout the depth of such portions. In making activated carbons, the eroding or activation process produces the funnel-shaped cavities; activating or eroding carbonized synthetic polymer with steam or the like will substantially deteriorate and eventually destroy the improved volume or pressure change per degree temperature change of adsorbed gas in the carbonized synthetic polymer. The slit-like cavities of the carbonized synthetic polymer are believed to result from the production of the cavities by removing or volatilizing the non-carbon components of the polymer while in a solid state.

It is also theorized that the width or diameter of the cavities or pores, or their inlets, substantially effects the adsorbent properties of the carbon material. Using a Kelvin method of measuring pore size, it has been determined that the pore size of carbonized polyvinylidene chloride ranges from 10 to 15 angstroms in width of diameter, while the diameter of pores in activated charcoal ranges from 15 to 200 angstroms with an average pore size much larger than 17 angstroms. An average cavity or inlet width in the range generally from about 9.2 angstroms to about 17 angstroms and preferably from 12 to 15 angstroms in the carbonized synthetic polymer produces the improved volume or pressure change per degree temperature change. The cavity size of carbonized polymer can be reduced by heating in the range of from 1,510° C (2,750° F) to 2,205° C (4,000°C (4,000° F). A brief activation with steam, carbon dioxide or the like can be employed to enlarge the cavities.

Van der Waals' forces are theorized as being the main attractive force resulting in adsorption of gas molecules. The width of the cavities in the carbonized synthetic polymer being slightly larger than 2 diameters of the monatomic molecules of noble gas result in increased van der Waals' forces within the cavities due to the closeness of several crystalline faces, carbon lattice structures, or walls in the cavities. Also, the van der Waals' forces are generally greater for larger molecules which results in the heavier monatomic gases having a greater volume or pressure change per degree of temperature change than the lighter monatomic gases. Since van der Waals' forces are attributed to weak dipoles, the carbon lattice arrangement produced by the carbonization of a synthetic polymer may have a stronger dipole than other atomic crystalline structures. The apparent van der Waals' forces, as judged by internal pressure change per degree of temperature change of the carbonized synthetic polymer are approximately 1.8 times that of activated carbon.

Another structural distinction is found in the number of cavities in a unit weight of the adsorbent carbon material. Carbonized polyvinylidene chloride as measured by a BET method has a surface area of 1,200 $m^2$/gram whereas activated charcoal has a surface area in the range from 500 to 1,000 $m^2$/gram. The surface area is believed to be proportional to the number of pores. The formation of pores or cavities by removing the non-carbon components of the carbonaceous compound leaving a skeletal carbon structure is believed to result in a more porous structure than that formed by eroding or activating cavities in a carbon material.

One advantage of using a nobel gas in the flame switch is that the noble gas will maintain its pressure for longer durations of time than more reactive gases. It has been observed that there is substantially less diffusion of the noble gases into metal than for more reactive gases; thus, the use of a noble gas results in less leakage of gas from the bulb 36, tube 38, and switch actuator 60 by diffusion producing a longer lasting and more reliable flame switch.

A burner system employing a flame safety switch operated by a gas charge in a bulb containing an adsorbent material, and, particularly, an unactivated carbonized compound, has the advantage of being responsive to temperatures which can be selected in accordance with the burner system. Different pilot burners or different mounting arrangements for flame sensing bulbs can result in different temperatures applied to a temperature sensing bulb. Since operation of liquid containing flame sensing bulbs which operate switches by vapor pressure from the liquid are generally limited to operating temperature near the boiling point of the liquid, systems utilizing such liquid containing bulbs must be carefully designed taking into account the strict limitations of the properties and requirements of the liquid containing bulb. the unactivated carbonized compound has adsorption properties which produce nearly linear volume or pressure response with respect to temperature change over wide range of temperatures thus making possible wide variations in the design of a safety switch with a bulb containing an adsorbent material and as gas charge to handle the requirements of the burner system and to avoid undesirable characterisitcs in the burner system resulting from strict design features required to meet the characteristics of flame safety switches with liquid containing bulbs.

Figure 5:
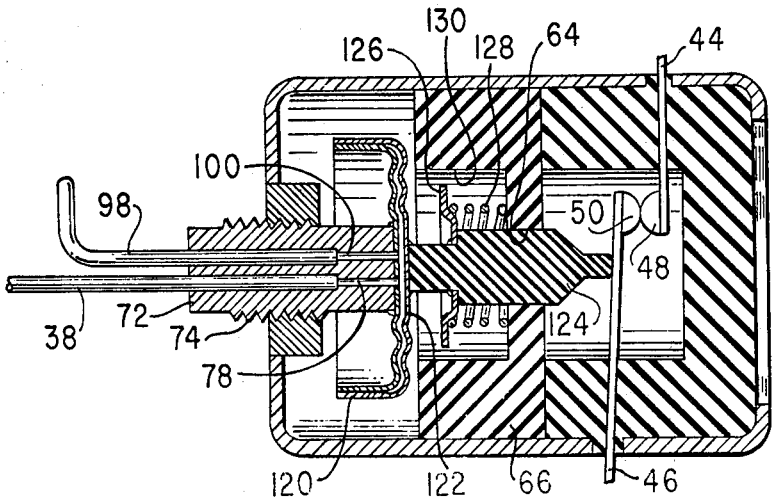
FIG. 5 is a cross section view of an alternate switch device.

A modified flame switch is shown in FIG. 5 wherein some parts are identified by the same numerals used to identify parts in the embodiment shown in FIGS. 1, 2, 3 and 4, indicating that such commonly identified parts have substantially similar structure and/or function. The modified flame switch has a bellows 120 secured to the support member 72 with the bores 78 and 100 communicating to the interior of the bellows 120. The bellows 120 has a movable wall 122 which engages a switch operator 124 slidably mounted within the bore 64 in the insulator 66 for engagement with the resilient contact arm 46. A washer 126 is mounted on the switch operator 124 which has a compression spring 128 therearound interposed between the washer 126 and the bottom of a recess 310 formed within the insulator 68.

In operation of the modified flame switch shown in FIG. 5, the bellows 120 in response to the gas pressure generated within tube 38 by adsorbent material in a bulb moves the switch operator 124 opening and closing the switch contacts 48 and 50 to open or complete a circuit between the contact arms 44 and 46. The spring 128 maintains the switch operator 124 biased against the bellows wall 122.

Since many variations, modifications and changes in detail can be made to the present embodiment, it is intended that all matter in the foregoing description and the accompanying drawings be interpreted as illustrative and not in a limiting sense.

What is claimed is:

1. A burner system comprising a main burner, an electrically operated valve for controlling the supply of fuel to the main burner, a pilot burner for igniting the main burner, a flame sensing bulb positioned to be impinged upon by a flame from the pilot burner, a flame switch having expandable and contractable means for opening and closing a pair of contacts in response to a gas pressure, a tube connecting the flame sensing bulb to the expandable and contactable means of the flame switch, a gas adsorbent material in the flame sensing bulb, a charge of gas in the sensing bulb, the tube and the expandable and contractable means, control means connected in series with the contacts of the switch means and the electrically operated valve for controlling the electrically operated valve, and the gas adsorbent material including a material selected from carbonized polyvinylidene chloride and carbonized polyvinylidene fluoride.

2. A burner system as claimed in claim 1 wherein the gas includes a substantial portion of gas selected from helium, neon, argon, krypton and xenon.

3. A burner system comprising a main burner, an electrically operated valve for containing the supply of fuel to the main burner, a pilot burner for igniting the main burner, a flame sensing bulb positioned to be impinged upon by a flame from the pilot burner, a flame switch having expandable and contractable means for opening and closing a pair of contacts in response to a gas pressure, a tube connecting the flame sensing bulb to the expandable and contractable means of the flame switch, a gas adsorbent carbonaceous material in the flame sensing bulb, a charge of noble gas in the sensing bulb, the tube and the expandable and contractable means, control means connected in series with the contacts of the switch means and the electrically operated valve for controlling the electrically operated valve, and said adsorbent carbonaceous material including a material selected from carbonized polyvinylidene chloride and carbonized polyvinylidene fluoride and being porous with cavities in a skeletal structure with substantially uniform inlets wherein the average width of the inlets of the cavities is within the range from 9.2 angstroms to 17 angstroms.

4. A burner system as claimed in claim 3 wherein the change of gas is selected from argon, krypton and xenon.

* * * * *